US006206609B1

(12) United States Patent
Trangsrud

(10) Patent No.: US 6,206,609 B1
(45) Date of Patent: Mar. 27, 2001

(54) EXTENSION FOR A CANAL BED LINER

(75) Inventor: Julian P. Trangsrud, Northfield, MN (US)

(73) Assignee: Royal Environmental Systems, Inc., Stacy, MN (US)

( * ) Notice: Subject to any disclaimer, the term of this patent is extended or adjusted under 35 U.S.C. 154(b) by 0 days.

(21) Appl. No.: 09/374,405

(22) Filed: Aug. 13, 1999

(51) Int. Cl.[7] ..... E02D 29/14; F16L 5/00

(52) U.S. Cl. ..... 404/25; 405/154; 52/20; 52/245; 52/247; 137/363

(58) Field of Search ..... 404/25, 26; 52/19, 52/20, 21, 245, 247, 169.6; 137/363, 364; 405/154

(56) References Cited

U.S. PATENT DOCUMENTS

| | | | | |
|---|---|---|---|---|
| 1,639,495 | * | 8/1927 | Frame . | |
| 1,712,510 | * | 5/1929 | Monie . | |
| 1,959,171 | * | 5/1934 | Mayer . | |
| 4,089,139 | * | 5/1978 | Moffa et al. | 52/20 |
| 4,422,994 | | 12/1983 | Ditcher | 264/219 |
| 4,553,561 | * | 11/1985 | Morris | 137/362 |
| 4,565,347 | | 1/1986 | Ditcher | 249/83 |
| 4,582,449 | * | 4/1986 | Vosswinkel | 404/25 |
| 4,737,220 | * | 4/1988 | Ditcher et al. . | |
| 4,751,799 | | 6/1988 | Ditcher et al. | 52/21 |
| 4,941,643 | | 7/1990 | Ditcher | 249/145 |
| 4,957,389 | * | 9/1990 | Neathery | 404/72 |
| 4,961,293 | | 10/1990 | House et al. | 52/21 |
| 5,081,802 | * | 1/1992 | Westhoff et al. . | |
| 5,261,761 | | 11/1993 | Knappert et al. | 404/25 |
| 5,299,884 | * | 4/1994 | Westhoff et al. | 404/25 |
| 5,492,656 | | 2/1996 | Tracy | 264/32 |
| 5,752,787 | * | 5/1998 | Trangsrud | 405/154 |
| 5,785,452 | * | 7/1998 | Milo et al. | 404/25 |
| 5,899,629 | * | 5/1999 | Milo et al. | 404/25 |
| 5,901,506 | | 5/1999 | Zicaro et al. | 52/20 |

* cited by examiner

*Primary Examiner*—Thomas B. Will
*Assistant Examiner*—Gary S. Hartmann
(74) *Attorney, Agent, or Firm*—Nikolai, Mersereau & Dietz, P.A.

(57) ABSTRACT

An extension collar suitable for engagement with an upper ledge of an invert liner positioned within the canal bed of the base of a manhole or catch basin structure. The extension collar is replaceable and is suitable for use in either new construction or rehabilitation of the manhole structure. A plurality of extension collars may be sealably stacked one on top of the other to create a corrosion resistant barrier at a desired height from the bottom of the base of the manhole or catch basin.

14 Claims, 5 Drawing Sheets

EXTENSION FOR A CANAL BED LINER

BACKGROUND OF THE INVENTION

I. Field of the Invention

This invention relates generally to the components of a manhole structure and more particularly relates to components utilized in the base of a manhole system including an invert liner formed or positioned within the base thereof. The replaceable extension collar of the present invention is adapted for sealable engagement with the invert liner and is suitable for use in either new construction or rehabilitation of the manhole structure.

II. Discussion of the Prior Art

Sanitary and storm systems generally comprise a plurality of networked pipelines. These pipelines typically pass through or join together at a manhole or catch basin structure. The manhole or catch basin structure serves as a node for the sewer or drainage system and also provides access for inspection. A manhole or catch basin structure typically includes a base having concentric inner and outer side walls extending upward, a cone which rests on top of the base, adjusting rings which rest on top of the cone, a support frame, and a cover or grate that is placed on top of the support frame. The base and cone of the manhole structure is typically constructed of a mortared block or casted concrete and is susceptible to erosion over time.

Fluids passing through the manhole structure tend to deteriorate the portion of the manhole system that is in direct or causal contact with the fluids. These fluids may include sewage and putrid water, which are very acidic and may comprise hydrogen sulfide and sulfuric acid. Over time, exposure to sewage, putrid water, or the gases emitted therefrom may damage the concrete of the canal bed, base, and cone. Also, in catch basins, road salt may also deteriorate the concrete base of the catch basin. This is due to the eventual breakdown of the concrete by the road salt, especially if the concrete is of poor quality. When repair or replacement of these manhole or catch basin structures is required, due to a deteriorated canal bed, base or cone, the procedure is extremely expensive, time consuming, difficult, and may even require excavation and removal of some or all of the manhole structure.

Although manhole base polymer liners have been provided for lining the canal bed of the base, these liners typically terminate in the bottom portion of the base and at least a portion of which is embedded in the base itself. Although a majority of the fluid passing through the manhole or catch basin is in direct contact with the liner, a small amount of the fluid may contact the sidewalls of the base. Over time this minimal contact with the sidewalls may cause damage to the sidewalls of the base. Hence, there is a need for a replaceable device suitable for protecting the base side walls from the corrosive nature of the fluids passing there through, which may be utilized in either new construction or rehabilitation of the manhole or catch basin structure. The present invention meets these and other needs that will become apparent from a review of the description of the present invention.

SUMMARY OF THE INVENTION

The purpose of the present invention is to provide a replaceable extension collar for use in a manhole structure that is adaptable for sealable engagement to an upper edge of an invert liner positioned within the base of a manhole structure. The extension collar of the present invention includes an annular center section, an upper ledge, and a lower ledge. The center section is annular and is shaped to fit within the manhole structure and includes inner and outer concentric sidewalls having an opening extending between an upper portion and a lower portion of the center section. The upper ledge extends outwardly from the upper portion of the center section and is suitable for stacking another similarly shaped collar thereon. The opening extending through the collar is sized for user access there through. The lower ledge extends outwardly from the lower portion of the center section and may further include a flange extending upward from an outer portion of the lower ledge.

In use, one or more replaceable extension collars are stacked and sealingly engaged to an upper edge of an invert liner positioned within the base of a manhole structure. An invert liner of known suitable construction is described in further detail in U.S. patent application Ser. No. 09/039,053 filed on Mar. 13, 1998 and assigned to the same assignee as the present invention, the entire disclosure of which is incorporated herein by reference for any purpose. The extension collar acts as a shield to the concrete base sidewalls and may be replaced as required. A sealing material such as sponge rubber, silicone rubber, butyl rubber or other material of known suitable construction capable of providing a sealing joint between two polymers and resistant to deterioration in a caustic environment may be positioned between the lower ledge of the ring and the upper edge of the invert liner. Alternatively, an adhesive may be utilized to adhere the bottom surface of the lower portion of the extension collar to the upper edge of the invert liner.

OBJECTS

It is accordingly a principal object of the present invention to provide a replaceable extension collar for use in a manhole structure adaptable for engagement to an upper edge of an invert liner positioned within the base of a manhole structure.

Another object of the present invention is to provide an extension collar suitable for use in either new construction or rehabilitation of a manhole structure, thereby extending the sidewalls of an invert liner upward towards the top of the base of the manhole.

Still another object of the present invention is to provide a replaceable extension collar that is quickly removed and replaced without affecting the remaining portion of the manhole base continuity.

These and other objects and advantages of the present invention will become readily apparent to those skilled in the art from a review of the following detailed description of the preferred embodiment especially when considered in conjunction with the claims and accompanying drawings in which like numerals in the several views refer to corresponding parts.

DESCRIPTION OF THE PREFERRED EMBODIMENT

Figure 1:
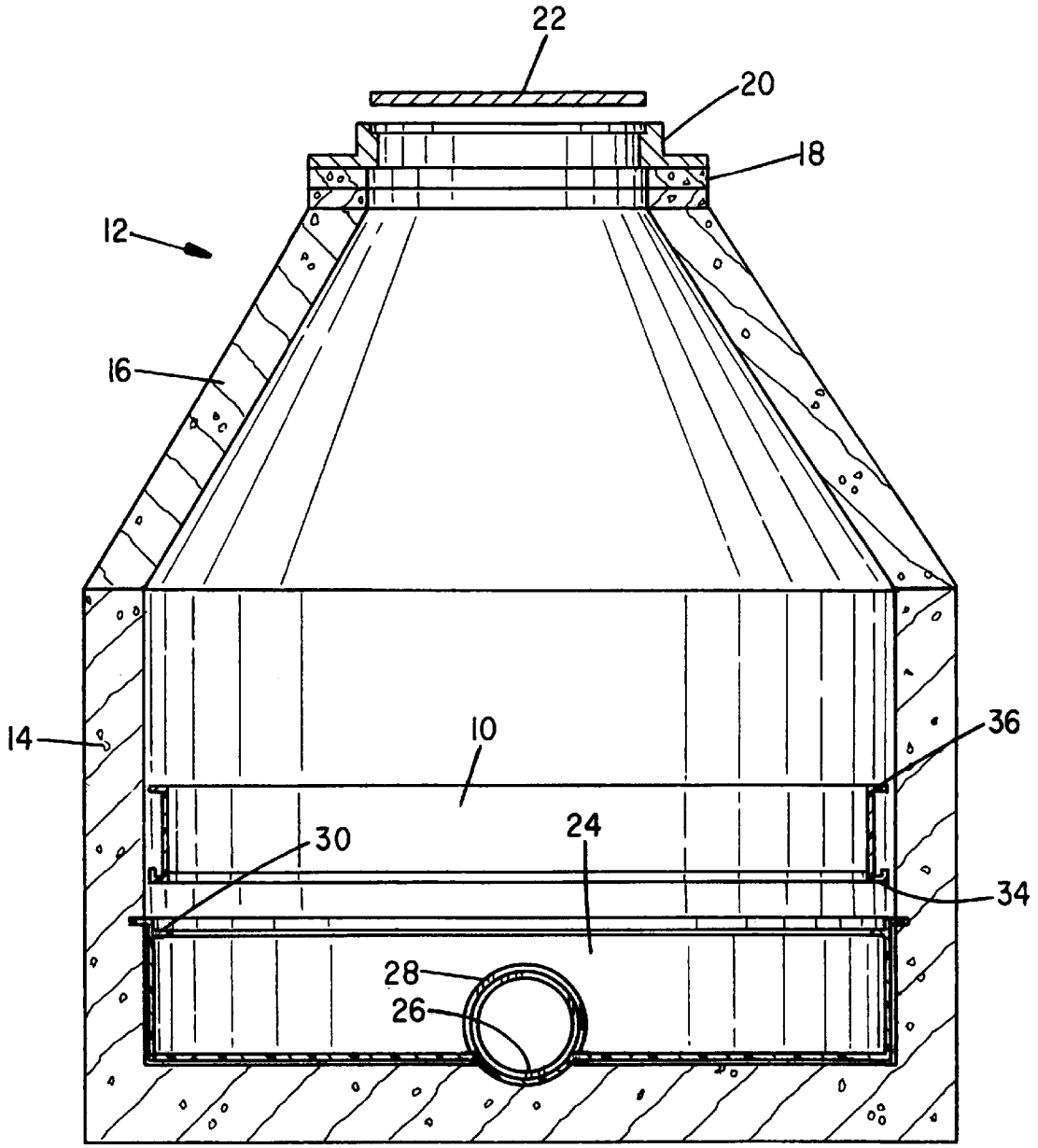
FIG. 1 is a partial sectional exploded perspective view of the extension collar of the present invention elevated above an invert liner positioned within the base of a manhole structure.

The present invention represents broadly applicable improvements to manhole and catch basin structures. The embodiments detailed herein are intended to be taken as representative or exemplary of those in which the improvements of the invention may be incorporated and are not intended to be limiting. Referring first to FIG. 1, there is shown generally a replaceable extension collar 10 positioned within a typical manhole structure 12. The manhole structure 12 includes a base 14, cone 16 positioned on top of the base 14, adjusting rings or extension members 18 positioned on a top portion of the cone 16, manhole cover support frame 20 positioned on top of the extension members 18, and manhole cover 22. Embedded within an inner portion of the manhole base 14 is an invert liner 24. The extension collar 10 is shown elevated above the invert 24.

Figure 2:
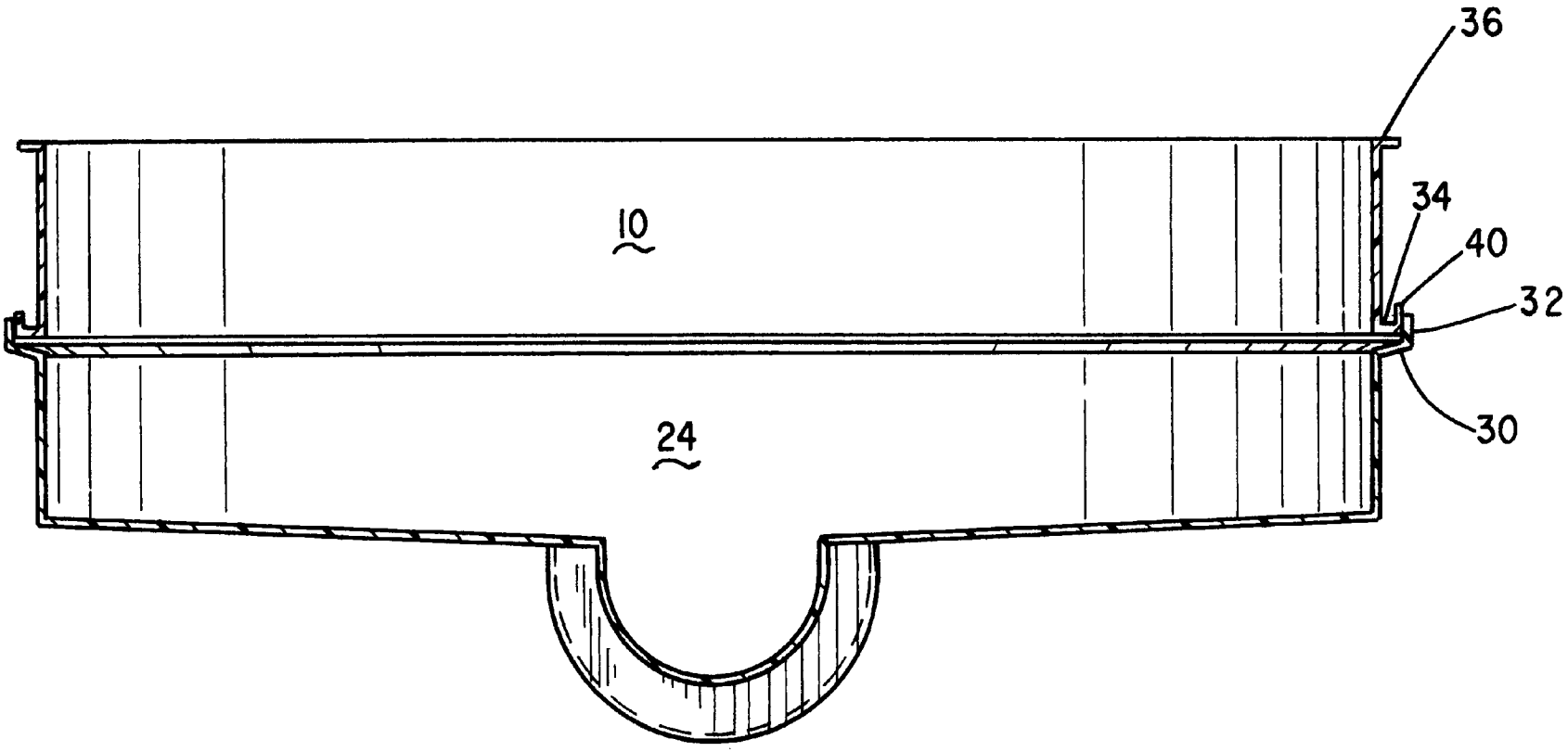
FIG. 2 is a partial sectional side elevational view showing the extension collar of the present invention engaged to the upper edge of an invert liner.
Figure 3:
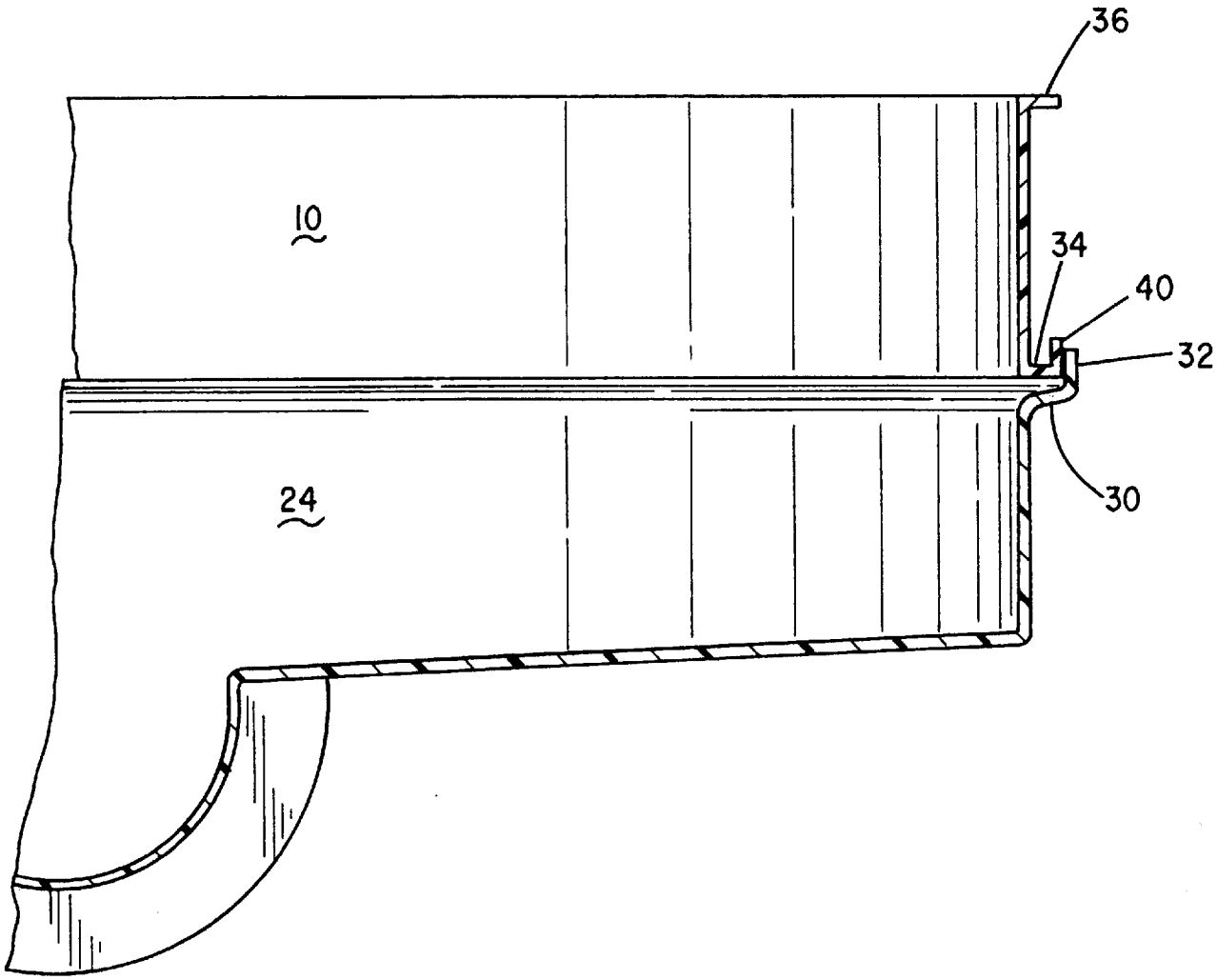
FIG. 3 is a fragmentary partial sectional enlarged view of the collar and invert liner shown in FIG. 2.

Referring next to FIGS. 2 and 3, the replaceable extension collar 10 is shown aligned and engaged with the upper support ledge 30 of the invert liner 24. The invert liner includes a channel 26 formed in a bottom portion of the liner which extends out through a bore 28 formed in the sidewall of the invert or canal bed liner 24. The upper support ledge 30 extends outwardly from the sidewalls of the canal bed liner 24 and includes a lip 32 extending upwardly from an outer portion of the support ledge 30. Alternatively, the support ledge 30 of the invert liner 24 may extend inwardly from the invert sidewall as shown in FIG. 1. The extension collar includes a lower ledge 34 and upper ledge 36 extending outwardly from the sidewall of the collar 10. The lower ledge 34 of the extension collar 10 aligns and is sealably engaged with the support ledge 30 of the invert liner 24. Those skilled in the art will appreciate that additional fasteners of known suitable construction may be utilized to engage the collar 10 to the support liner 24.

Figure 4:
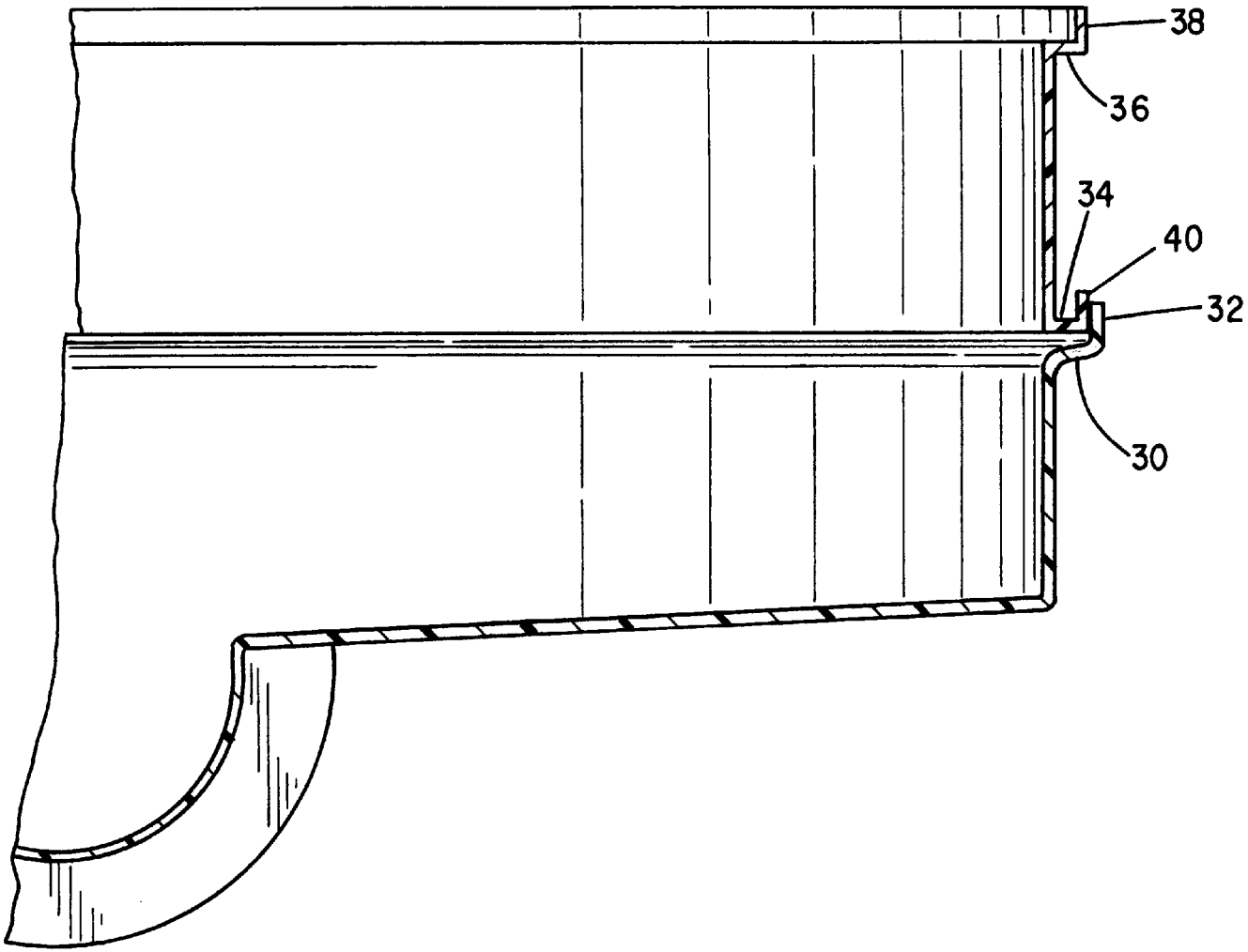
FIG. 4 is a partial sectional side elevational view of an alternate preferred extension collar of the present invention shown engaged to the upper edge of an invert liner.

FIG. 4 shows an alternate embodiment of the collar 10, wherein the upper ledge 36 includes a lip 38 extending upwardly therefrom. A second collar 10 may be stacked on top of the first collar 10, wherein the lower ledge 34 of the second collar may be scalably engaged to the upper ledge 36. A flange 40 may further extend from the lower ledge 34 of the collar and may further sealably engage the lip 38 extending from the upper ledge 36. In this manner, the sidewalls of the base 14 may be protected from the caustic effects of fluids passing therethrough without requiring a permanent liner affixed to the sidewall. Further, collar may be removed and/or replaced without affecting the structural integrity of the remaining portion of the base of the manhole.

Figure 5:
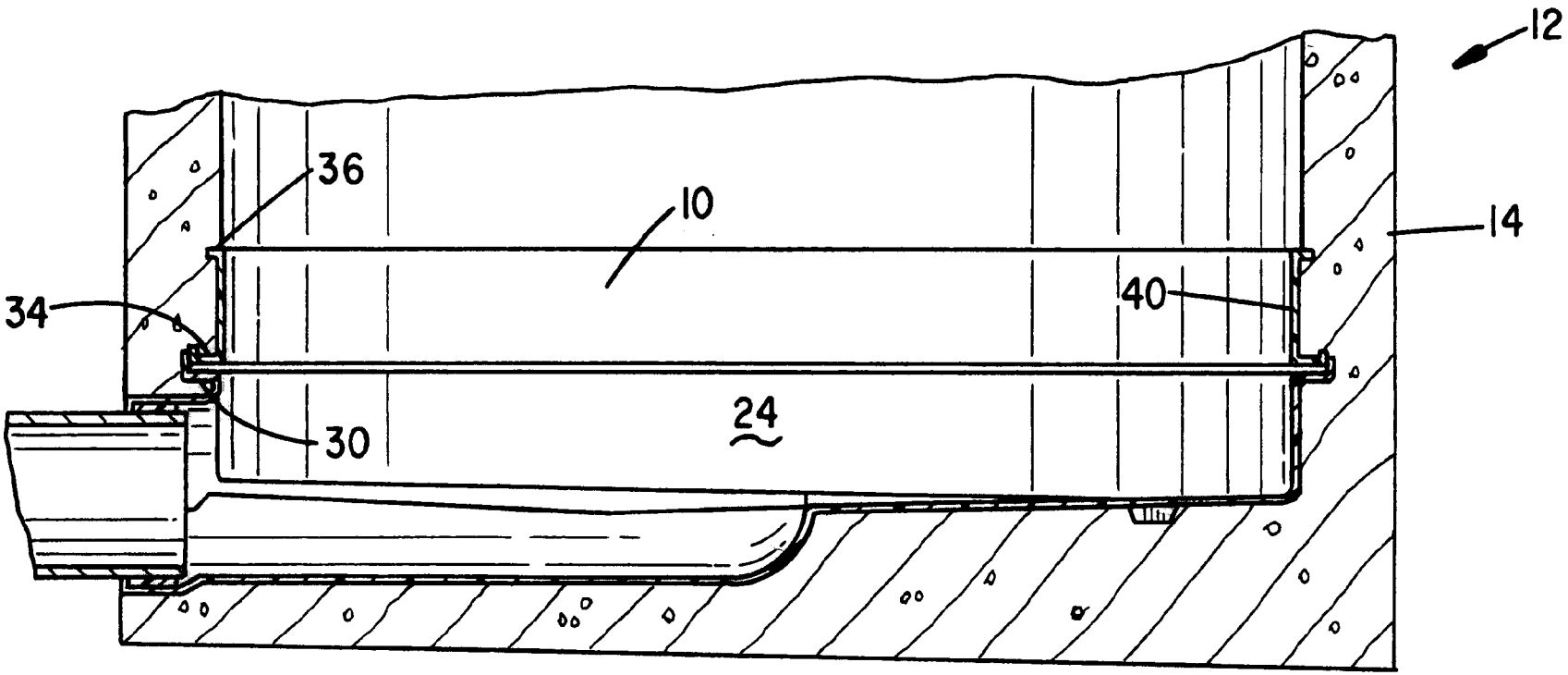
FIG. 5 is a partial sectional side elevational view showing the upper and lower ledges of the extension collar embedded in the base of the manhole structure.

FIG. 5 illustrates an alternate embodiment of the invert liner 24 suitable for use in new construction of the manhole structure 12. The edge 30 of the invert liner 24 extends outwardly and is embedded within the sidewall of the manhole base 14. The lower ledge 34 of the collar 10 may be sealably engaged to the edge 30 of the invert liner and is likewise embedded within the sidewall of the manhole base 14. The outside wall of the center section 40 engages the sidewall 14 and the upper ledge 36 extending outwardly from the center section 40 is embedded within the sidewall of the manhole base 14.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A replaceable extension collar positioned in a manhole structure and engageable with an upper edge of an invert liner positioned within the base of the manhole structure, said extension collar comprising:

(a) an annular center section shaped to fit within said manhole structure, said center section having inner and outer concentric sides and an opening extending between an upper portion and lower portion of the center section, wherein a diameter of the outer concentric side is less than an inner diameter of said base of said manhole structure;

(b) an upper ledge extending outwardly from the upper portion of said center section; and (c) a lower ledge extending outwardly from the lower portion of said center section, wherein said upper ledge is adapted for receiving a lower ledge of a similar extension collar positioned in stacked relation to said extension collar.

2. The extension collar as recited in claim 1, further including a flange extending upward from the lower ledge of said extension collar.

3. The extension collar as recited in claim 1, wherein the opening is sized for user access therethrough.

4. The extension collar in accordance with claim 1, wherein said collar is formed of a fluid impermeable molded polymer material.

5. The extension collar as recited in claim 1, wherein the lower ledge of said collar is sealingly engaged to the upper edge of the invert liner positioned within the base of the manhole structure.

6. A replaceable extension collar positioned in a manhole structure and engageable with an upper edge of an invert liner positioned within the base of the manhole structure, said extension collar comprising:

(a) an annular center section shaped to fit within said manhole structure, said center section having inner and outer concentric sides and an opening extending between an upper portion and lower portion of the center section, wherein a diameter of the outer concentric side is less than an inner diameter of said base of said manhole structure;

(b) an upper ledge extending outwardly from the upper portion of said center section, said lower ledge including a flange extending upward from the lower ledge; and (c) a lower ledge extending outwardly from the lower portion of said center section, wherein said upper ledge is adapted for receiving a lower ledge of a similar extension collar positioned in stacked relation to said extension collar.

7. The extension collar as recited in claim 6, wherein the opening is sized for user access there through.

8. The extension collar in accordance with claim 6, wherein said collar is formed of a fluid impermeable molded polymer material.

9. The extension collar as recited in claim 6, wherein the lower ledge of said collar is sealingly engaged to the upper edge of the invert liner positioned within the base of the manhole structure.

10. A replaceable extension collar positioned in a manhole structure and engageable with an upper edge of an invert liner positioned within the base of the manhole structure, said extension collar comprising:

(a) an annular center section shaped to fit within said manhole structure, said center section having inner and outer concentric sides and an opening extending between an upper portion and lower portion of the center section, wherein the opening is sized for user access there through;

(b) an upper ledge extending outwardly from the upper portion of said center section; and (c) a lower ledge extending outwardly from the lower portion of said center section, wherein said upper ledge is adapted for receiving a lower ledge of a similar extension collar positioned in stacked relation to said extension collar.

11. The extension collar as recited in claim 10, further including a flange extending upward from the lower ledge of said extension collar.

12. The extension collar in accordance with claim 10, wherein said collar is formed of a fluid impermeable molded polymer material.

13. The extension collar as recited in claim 10, wherein the lower ledge of said collar is sealingly engaged to the upper edge of the invert liner positioned within the base of the manhole structure.

14. The extension collar in accordance with claim 11, wherein said collar is formed of a fluid impermeable molded polymer material.

* * * * *

UNITED STATES PATENT AND TRADEMARK OFFICE

CERTIFICATE OF CORRECTION

PATENT NO. : 6,206,609 B1
DATED : March 27, 2001
INVENTOR(S) : Julian P. Trangsrud It is certified that error appears in the above-identified patent and that said Letters Patent is hereby corrected as shown below:

Column 4,
Line 55, change “said” to -- a --.
Line 58, change “a” to -- the --.

Signed and Sealed this

Tenth Day of February, 2004

JON W. DUDAS
*Acting Director of the United States Patent and Trademark Office*